US009272525B2

(12) United States Patent
Zimmerman et al.

(10) Patent No.: US 9,272,525 B2
(45) Date of Patent: Mar. 1, 2016

(54) SYSTEM AND METHOD FOR CONTROLLING AIR BUBBLE FORMATION IN SOLID INKJET PRINTER INK FLOW PATHS

(71) Applicant: Xerox Corporation, Norwalk, CT (US)

(72) Inventors: Jeremiah D. Zimmerman, Portland, OR (US); Jonathan R. Brick, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 32 days.

(21) Appl. No.: 14/023,693

(22) Filed: Sep. 11, 2013

(65) Prior Publication Data

US 2015/0070448 A1 Mar. 12, 2015

(51) Int. Cl.

| | |
|---|---|
| ***B41J 2/175*** | (2006.01) |
| ***B41J 2/19*** | (2006.01) |
| *B41J 2/165* | (2006.01) |

(52) U.S. Cl.

CPC ..... *B41J 2/19* (2013.01); *B41J 2/17593* (2013.01); *B41J 2002/16564* (2013.01)

(58) Field of Classification Search

CPC ..... B41J 2/19; B41J 2/17593; B41J 2/175; B41J 2/17513; B41J 2/17596; B41J 2/2117; B41J 2/48; B41J 2002/16564; B41J 2002/14169; B41J 2202/07; C09D 11/34

See application file for complete search history.

(56) References Cited

U.S. PATENT DOCUMENTS

| | | | | |
|---|---|---|---|---|
| 4,998,120 | A | 3/1991 | Koto et al. | |
| 5,041,844 | A | 8/1991 | Deshpande | |
| 5,621,444 | A | 4/1997 | Beeson | |
| 5,870,126 | A | 2/1999 | Kondo et al. | |
| 6,007,193 | A | 12/1999 | Kashimura et al. | |
| 6,276,790 | B1 * | 8/2001 | Ikezaki | 347/88 |
| 7,121,658 | B2 | 10/2006 | Platt et al. | |
| 7,144,100 | B2 | 12/2006 | Hill et al. | |
| 7,600,850 | B2 | 10/2009 | Blackburn et al. | |
| 7,682,008 | B2 | 3/2010 | Platt et al. | |
| 7,762,656 | B2 * | 7/2010 | Snyder | 347/88 |
| 8,393,715 | B2 | 3/2013 | Silverbrook | |
| 2007/0120895 | A1 | 5/2007 | Padgett et al. | |
| 2008/0122913 | A1 * | 5/2008 | Jones | B41J 2/17593 347/99 |
| 2010/0194835 | A1 * | 8/2010 | Jones | 347/88 |
| 2011/0298870 | A1 | 12/2011 | Casella et al. | |
| 2012/0200620 | A1 * | 8/2012 | Limb | 347/6 |

* cited by examiner

*Primary Examiner* — Geoffrey Mruk

(74) *Attorney, Agent, or Firm* — Maginot Moore & Beck LLP

(57) ABSTRACT

Protrusions are positioned on the inner surfaces of a channel within a printhead body or member to control the size and location of bubble formation. An inkjet printhead includes a member having a first opening and a second opening to enable melted ink to enter the channel at the first opening and flow through the channel to the second opening. At least one protrusion extends from the member into the channel to position a portion of the protrusion into melted ink in the channel to form a dominant stress concentration in the melted ink.

14 Claims, 3 Drawing Sheets

SYSTEM AND METHOD FOR CONTROLLING AIR BUBBLE FORMATION IN SOLID INKJET PRINTER INK FLOW PATHS

TECHNICAL FIELD

This disclosure relates generally to printheads for inkjet printers, and more particularly, to systems and methods for the control of the size and location of air bubbles that form in a liquid path for ink in a printhead.

BACKGROUND

Air bubbles in ink flow paths of inkjet printers can impact the performance of the printers. In printers that use solid ink, air bubbles are formed during the freezing and melting of the solidified ink. Typically, when a solid inkjet printer is not operating, melted ink in the ink flow paths solidifies.

FIG. 3A is a cross-sectional view of fluid paths, a pressure chamber, and air vents in a prior art inkjet in a printhead 500, and FIG. 3B is a top plan view of an exemplary nozzle plate 550 in a printhead that includes the inkjet of FIG. 3A. The exemplary print head 500 is configured for use in an inkjet printer. While FIG. 3A and FIG. 3B depict a single inkjet for illustrative purposes, existing printhead embodiments include multiple inkjets, including arrays of hundreds or thousands of inkjets in some embodiments.

In FIG. 3A, the printhead 500 includes a substrate 520, a silicon wafer 530 on an upper surface of the substrate 520, an ink passage 540 through the substrate 520 and silicon wafer 530, a tube 545 connecting the ink passage 540 of the print head 500 to an ink supply reservoir, and a nozzle plate 550 mounted on the structure. An electrostatically actuated membrane 560 is formed on the silicon wafer 530 as shown. A pressure chamber 565 receives liquid ink through the fluid ink passage 540. A nozzle hole 570 and a matrix of purge vents 590 (FIG. 3B) can be formed in the nozzle plate 550. The purge vents 590 in FIG. 3A and FIG. 3B are formed as a group of small nozzle holes formed through the nozzle plate 550. Air enters and leaves the pressure chamber 565 during operation of the print head 500 through the group of purge vents 590. The purge vents 590 are large enough to enable air to escape from the pressure chamber 565 as ink fills the pressure chamber, and to admit air when liquid ink in the pressure chamber solidifies in embodiments of the printhead 500 that use a phase-change ink.

In the print head 500, the membrane 560 is an electrostatically actuated diaphragm, in which the membrane 560 is controlled by an electrode 562. The membrane 560 can be made from a structural material such as, for example, polysilicon, as is typically used in a surface micromachining process. An air vent 564 between membrane 560 and wafer 530 can be formed using typical techniques, such as by surface micromachining. The electrode 562 acts as a counterelectrode and is typically either a metal or a doped semiconductor material, such as polysilicon. Alternative inkjet embodiments include a piezoelectric actuator or a thermal actuator.

During operation of an electrostatic or piezoelectric actuator, the electrode 562 receives an electrical signal and the membrane 564 deflects into the pressure chamber 565. The deformation generates pressure on the ink in the pressure chamber 565 and the pressure urges an ink drop, such as the ink drop 582, through the nozzle 570. In some configurations, the membrane 560 deflects toward the electrode 562 prior to deflection into the pressure chamber 565 to draw ink into the pressure chamber 565 for ejection through the nozzle 570. In a thermal inkjet, the electrical signal generates heat in the pressure chamber and the heat produces an air bubble that urges ink in the pressure chamber 565 through the nozzle 570 to eject an ink drop in a similar manner to the arrangement of FIG. 3A.

The purge vents 590 in the nozzle plate 550 have diameters that are typically smaller than the diameter of the nozzle 570, and are sufficiently narrow to prevent ink from passing through the nozzle plate 550 at a location other than the nozzle 570 during operation of the printhead 500. During operation, a meniscus of liquid ink forms across the opening to each of the purge vents 590 from the nozzle plate 550 to the pressure chamber 565. The strength of the meniscus enables ink to remain in the pressure chamber 565 and to be ejected through the nozzle 570 without being ejected or otherwise leaking through the purge vents 590. In one embodiment, each of the purge vents 590 is formed with a diameter of approximately 3 to 5 microns. In comparison, the diameter of the nozzle 570 is approximately 27.5 microns in the embodiment of FIG. 3A. The small size of the purge vents 590 minimizes the impact of the vents on the flow of liquid ink to the inkjet, which enables the ink to flow to the pressure chamber 565 with sufficient liquid pressure to supply the inkjet with ink during printing operations.

In the prior art embodiment, the vents 590 enable air bubbles to escape from liquid ink in the fluid path 540 and pressure chamber 565. Some air bubble, however, may be formed in portions of the printhead where the air bubbles are unable to be vented easily. For example, in the printhead 500 an air bubble that forms near the nozzle 570 does not escape through the vents 590, but instead escapes through the nozzle 570 where the air bubble disrupts the process of ejecting ink drops. Additionally, while small air bubbles that form near the vents 590 can escape from the printhead 500, larger air bubbles formed within the channel 540 and the pressure chamber 565 can interrupt the flow of ink to the pressure chamber 565 for a longer period of time before escaping from the printhead 500. What is needed is a printhead design that mitigates the formation of air bubbles in locations that are difficult to purge, and mitigates the formation of large air bubbles.

SUMMARY

An inkjet printhead has been developed that facilitates the removal of air bubbles from ink flow paths in a printhead and helps reduce the size of air bubbles formed in the ink flow paths. The inkjet printhead includes a member having a channel through the member with a first opening and a second opening to enable melted ink to enter the channel at the first opening and flow through the channel to the second opening, and at least one protrusion extending from the member to position a portion of the protrusion into melted ink in the channel to form a dominant stress concentration in the melted ink.

A method of making an inkjet printhead has been developed that facilitates the removal of air bubbles from ink flow paths in a printhead and helps reduce the size of air bubbles formed in the ink flow paths. The method includes providing a vent in a member having a channel with a first opening and a second opening to enable melted ink to enter the channel at the first opening and flow through the channel to the second opening, and providing at least one protrusion extending from the member into the channel to position a portion of the protrusion into melted ink in the channel to establish a dominant stress concentration in the melted ink for forming air bubbles at a predetermined location in the channel.

The inkjet printhead and method can be used in an inkjet printer to facilitate the removal of air bubbles from ink flow paths in a printhead and help reduce the size of air bubbles formed in the ink flow paths. The inkjet printer includes a printhead having a body, a reservoir, a channel within the printhead body that is fluidly connected to the reservoir, the channel having a first opening and a second opening to enable melted ink to enter the channel at the first opening and flow through the channel to the second opening, and at least one protrusion extending from the printhead body into the channel to position a portion of the protrusion into melted ink in the channel to enable air bubble formation at the protrusion.

DETAILED DESCRIPTION

Figure 1A:
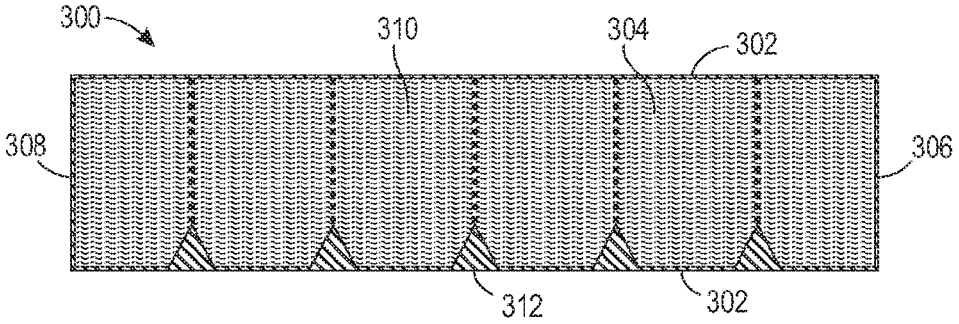
FIG. 1A depicts a fluid path for use in a printhead that includes protrusions to control the formation of air bubbles within the fluid path when the fluid path is filled with a liquid ink.
Figure 1B:
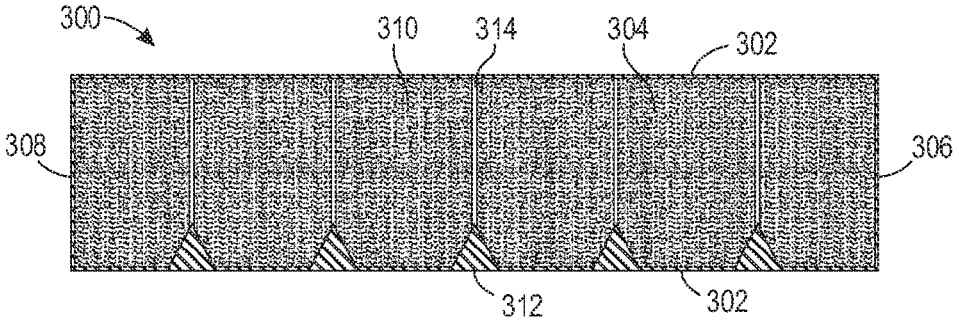
FIG. 1B depicts the fluid path of FIG. 1A when the fluid path contains solidified ink.
Figure 1C:
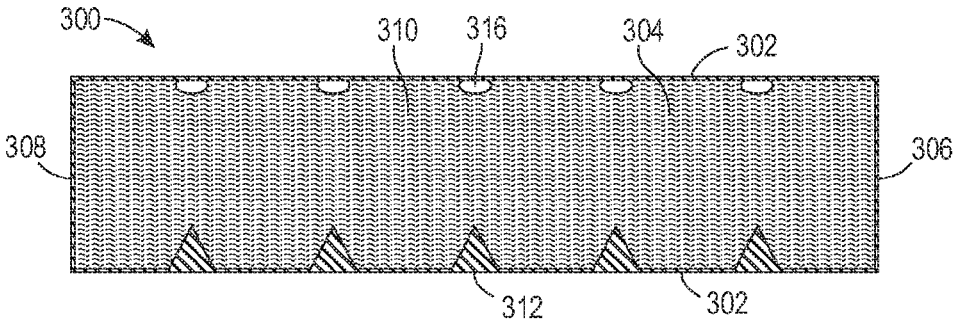
FIG. 1C depicts the fluid path of FIG. 1A and FIG. 1B after solidified ink in the fluid path returns to a liquefied state.
Figure 2A:
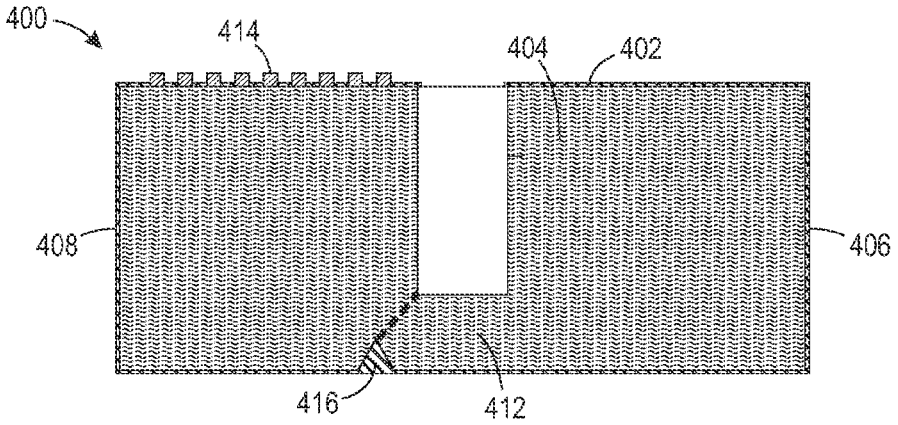
FIG. 2A depicts another fluid path for use in a printhead that includes a protrusion to control the formation of air bubbles within the fluid path when the fluid path is filled with a liquid ink.
Figure 2B:
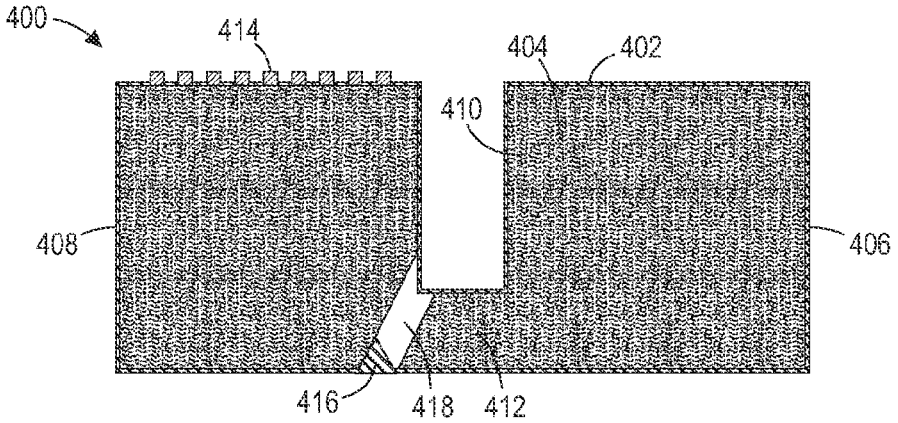
FIG. 2B depicts the fluid path of FIG. 2A when the fluid path contains solidified ink.
Figure 2C:
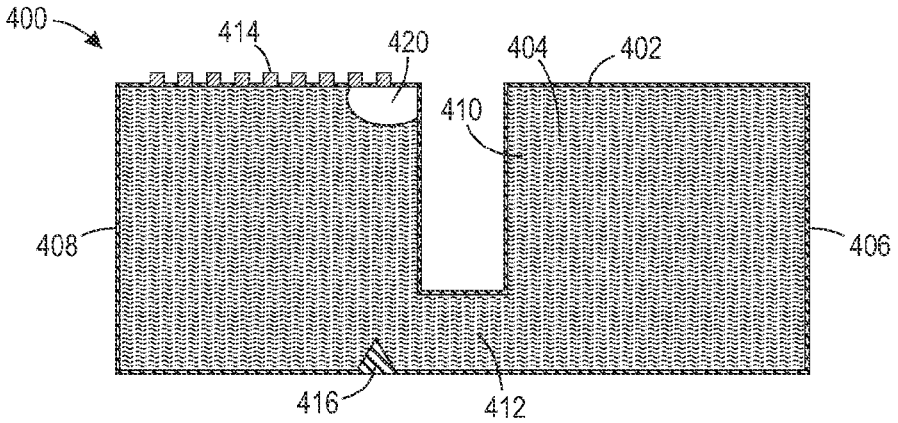
FIG. 2C depict the fluid path of FIG. 2A and FIG. 2B after solidified ink in the fluid path returns to a liquefied state.
Figure 3A:
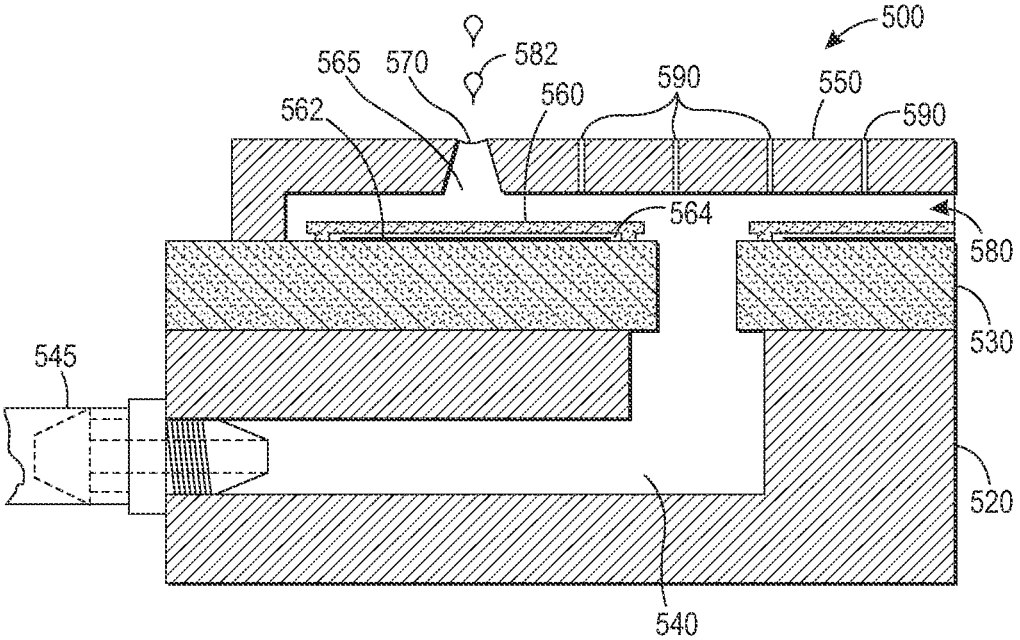
FIG. 3A PRIOR ART
FIG. 3A depicts a cross-sectional view of a prior art inkjet in a prior art printhead.
Figure 3B:
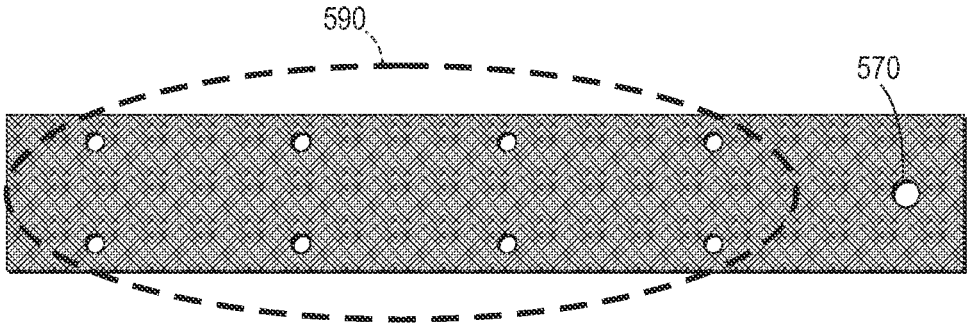
FIG. 3B PRIOR ART
FIG. 3B depicts a plan view of a prior art nozzle plate in the printhead of FIG. 3A.

Protrusions can be arranged in a printhead flow path to mitigate the formation of large air bubbles that are difficult to remove. FIG. 1A-FIG. 1C depict a printhead channel 300 within a member or body of the printhead that enables ink to flow through the printhead and a plurality of protrusions formed in the channel to control the locations of bubble formation within the channel 300. Referring to FIG. 1A, the printhead channel 300 provides a flow path 304. The flow path 304 has two opposite ends 306 and 308. The flow path 304 is filled completely with melted solid ink 310, which flows from the end 306 to the end 308 during normal operation. However, unlike the pressure chamber 565 in FIG. 3A, the printhead channel 300 includes protrusions 312. The protrusions 312 are arranged along the wall 302, and extend from the wall 302 into the flow path 304 and, accordingly, into the solid ink 310. The protrusions 312 modify the nominal stress concentrations as the melted solid ink 310 solidifies by establishing dominant stress concentrations at each of the protrusions 312. As used in this document, the term "dominant stress concentration" refers to a local maximum in the average force per unit area that particles of a body exert on adjacent particles of the body. The dominant stress concentrations promote the cracking of the solid ink 310 at their locations when the solid ink 310 solidifies. The dotted lines represent the expected cracking points in the solid ink 310 as the ink shrinks during cooling and freezing. FIG. 1B depicts the printhead channel 300 of FIG. 1A in which the solid ink 310 has cooled and solidified within the flow path 304. As the solid ink 310 solidifies, cracks form in the solid ink and voids 314 are formed in the solid ink. However, the dominant stress concentrations at the protrusions 312 enable the voids 314 to form in a predictable and distributed manner. FIG. 2*c* depicts the printhead channel 300 of FIG. 2*b* in which the solidified solid ink 310 has been warmed to a temperature that enables the solidified solid ink to melt within the flow path 304. The voids 314 have turned into air bubbles 316. The air bubbles 316 are small and are distributed across the length of the flow path 304, thereby enabling the air bubbles 316 to be removed from the flow path 304 with less ink purged from the path. In this way, protrusions can be strategically arranged within a printhead flow path for the purpose of mitigating the formation of large and difficult to remove air bubbles. Smaller air bubbles can be forced out of the purge vents with less ink flow than larger air bubbles, reducing waste. Protrusions can be any of a variety of shapes such as conical, spherical, cylindrical, rectangular, and the like. The shapes and sizes of the protrusions are governed by the geometry of the channel, ambient conditions surrounding the printhead, processes for warming and cooling the printhead, active and passive thermal gradients, imposed pressure gradients, ink properties and the like.

In addition to controlling the size of air bubble formation, protrusions can also be strategically arranged to control the location of air bubble formation. FIG. 2A-FIG. 2C depict a printhead channel 400 within a member or body that defines a flow path 404 for ink. The flow path 404 has two opposite ends 406 and 408. The flow path 404 is completely filled with melted solid ink 410, which flows from the end 406 to the end 408 during normal operation. The flow path 404 has a narrow region 412. Purge vents 414 are arranged along the wall 402 near the end 408 and downstream of the narrow region 412. The narrow region 412 can cause the melted solid ink 410 to crack in the narrow region 412 as the ink solidifies. The printhead channel 400 includes a protrusion 416, which is positioned on the wall 402 near the narrow region 412 and substantially opposite the purge vents 414. The protrusion 416 extends into the flow path 404 to establish a dominant stress concentration near the narrow region 412 but angled slightly toward the end 408 and the purge vents 414. The dotted line represents the expected cracking point in the solid ink 410 as the ink shrinks during cooling and freezing.

FIG. 2B depicts the printhead channel 400 of FIG. 2A, wherein the solid ink 410 has cooled and solidified within the flow path 404. As the ink 410 cools and solidifies, the volume of the ink contracts and shrinks compared to the volume of the equivalent mass of ink in the liquid state. The shrinkage of the ink during the transition from the liquid state to the solid state of the ink 410 produces cracks and voids, such as the void 418. However, the dominant stress concentration established by the protrusion 416 near the narrow region 412 angles the void 418 slightly toward the end 408 and the purge vents 414. FIG. 2C depicts the printhead channel 400 of FIG. 2B, in which the solidified solid ink 410 has been warmed to a temperature that enables the solidified ink to melt within the flow path 404. The void 418 has turned into an air bubble 420. However, because the void 418 was angled slightly toward the end 408 and the purge vents 414, the air bubble 420 buoyed toward the purge vents 414 on one side of the narrow region 412, rather than possibly migrating toward the end 406, which does not have any purge vents. This bubble placement facilitates the removal of the bubble through the vents 414 during a purging process. Accordingly, the amount of ink required to purge the printhead channel 400 is significantly reduced over previously known printheads.

The protrusions disclosed in this document can be used to mitigate the size of air bubbles formed during a solidifying/ melting cycle as well as to control the locations where air bubbles are formed. By applying these concepts to different printhead geometries, printhead designers can establish predictability in the size and locations of air bubble formation. This predictability can be exploited to optimize the size, quantity, and locations of purge vents. An efficient purge vent layout in which air bubbles are properly staged near purge vents and extraneous purge vents are removed, results in a reduction of the amount of ink lost during purges and overall ink costs. Furthermore, the predictability allows printhead geometries to be scaled without substantially altering air bubble purging strategies.

These concepts are of even greater use for complex printhead geometries that can accommodate purge vents in fewer locations than simple geometry printheads. Protrusions can be arranged to control air bubble formation in such a way as to promote the formation of air bubbles in preferable areas, such as those were purge vents can be accommodated, while mitigating the formation of air bubbles in undesirable locations, such as those that will not accommodate a purge vent.

The geometries of the printhead channels shown in FIG. 1A-FIG. 1C and FIG. 2A-FIG. 2C are exemplary and have been greatly simplified for the purposes of promoting an understanding of the principles of the protrusions and their placements. Although typical printhead geometries are much more complex than those shown in the exemplary figures and embodiments, the principles can be applied to any printhead geometry for strategic control of both the size and the locations of air bubble formation.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An inkjet printhead comprising:

a member having a channel through the member with a first opening and a second opening to enable melted ink to enter the channel at the first opening and flow through the channel to the second opening; and at least one protrusion extending from the member to position a portion of the protrusion into melted ink in the channel to form a dominant stress concentration in the melted ink.

2. The inkjet printhead according to claim 1 further comprising:

a plurality of protrusions extending from the member into the channel to position a portion of the protrusions into melted ink in the channel.

3. The inkjet printhead according to claim 2, wherein the plurality of protrusions are configured to establish a plurality of local dominant stress concentrations in the melted ink.

4. The inkjet printhead according to claim 1 further comprising:

a vent positioned on the member with reference to the protrusion to enable an air bubble formed at the protrusion to pass through the member.

5. The inkjet printhead according to claim 4, wherein at least one protrusion establishes a dominant stress concentration in the melted ink at a position that enables air bubbles formed at the protrusion to reach the vent.

6. A method for controlling the size and location of air bubble formation in residual ink in an inkjet printhead comprising:

providing a vent in a member having a channel with a first opening and a second opening to enable melted ink to enter the channel at the first opening and flow through the channel to the second opening; and providing at least one protrusion extending from the member into the channel to position a portion of the protrusion into melted ink in the channel to establish a dominant stress concentration in the melted ink for forming air bubbles at a predetermined location in the channel.

7. The method according to claim 6 further comprising:

providing a plurality of protrusions extending from the member into the channel to position a portion of the protrusions into melted ink in the channel and establish a plurality of local dominant stress concentrations in the melted ink for forming air bubbles at predetermined locations in the channel.

8. The method according to claim 6 further comprising:

providing a vent positioned through the member to enable air bubbles in the melted ink within the channel to pass through the member.

9. The method according to claim 8 further comprising:

providing at least one protrusion at a position on the member with reference to the vent to position a portion of the protrusion into melted ink in the channel that enables air bubbles to reach the vent.

10. An inkjet printer comprising:

a printhead having a body;

a reservoir;

a channel within the printhead body that is fluidly connected to the reservoir, the channel having a first opening and a second opening to enable melted ink to enter the channel at the first opening and flow through the channel to the second opening; and at least one protrusion extending from the printhead body into the channel to position a portion of the protrusion into melted ink in the channel to enable air bubble formation at the protrusion.

11. The inkjet printer according to claim 10 further comprising:

a plurality of protrusions extending from the body into the channel to position a portion of the protrusions into melted ink in the channel.

12. The inkjet printer according to claim 11, wherein the plurality of protrusions are configured to establish a plurality of local dominant stress concentrations in the melted ink.

13. The inkjet printer according to claim 10, the channel further comprising:

a vent positioned on the body with reference to the protrusion to enable an air bubble formed at the protrusion to pass through the body.

14. The inkjet printer according to claim 13, wherein the at least one protrusion establishes a dominant stress concentration in the melted ink at a position that enables air bubbles formed at the protrusion to reach the vent.

* * * * *